US009145728B1

(12) United States Patent
LeBlanc

(10) Patent No.: US 9,145,728 B1
(45) Date of Patent: Sep. 29, 2015

(54) ELECTRONIC SAFE

(71) Applicant: William A. LeBlanc, Darlington, PA (US)

(72) Inventor: William A. LeBlanc, Darlington, PA (US)

( * ) Notice: Subject to any disclaimer, the term of this patent is extended or adjusted under 35 U.S.C. 154(b) by 0 days.

(21) Appl. No.: 14/213,874

(22) Filed: Mar. 14, 2014

Related U.S. Application Data

(60) Provisional application No. 61/786,282, filed on Mar. 14, 2013.

(51) Int. Cl.
*E05B 45/06* (2006.01)
*E05G 1/10* (2006.01)
*E05G 1/024* (2006.01)

(52) U.S. Cl.
CPC . *E05G 1/10* (2013.01); *E05G 1/024* (2013.01)

(58) Field of Classification Search
CPC ..... E05G 1/00; E05G 2700/02; E05G 1/10; E05G 1/005; G07C 9/00912; A47B 81/005
USPC ..... 340/542; 109/38, 50
See application file for complete search history.

(56) References Cited

U.S. PATENT DOCUMENTS

| | | | | | |
|---|---|---|---|---|---|
| 2,693,772 | A | | 11/1954 | Gibson | |
| 2,732,816 | A | | 1/1956 | Stein | |
| 5,111,755 | A | * | 5/1992 | Rouse | 109/25 |
| 5,416,826 | A | * | 5/1995 | Butler | 379/40 |
| 5,586,934 | A | | 12/1996 | Dombrowski et al. | |
| 5,768,343 | A | * | 6/1998 | Dame et al. | 379/33 |
| 5,901,589 | A | | 5/1999 | Cordero | |
| 5,987,941 | A | | 11/1999 | Zocco | |
| 6,363,760 | B1 | | 4/2002 | Sigmond | |
| 7,116,224 | B2 | | 10/2006 | Mickler | |
| 7,178,370 | B2 | | 2/2007 | Engel | |
| 8,922,335 | B2 | * | 12/2014 | Deweese et al. | 340/5.25 |
| 2004/0066275 | A1 | * | 4/2004 | Mickler | 340/5.33 |

(Continued)

FOREIGN PATENT DOCUMENTS

| | | |
|---|---|---|
| EP | 2 273 052 | 1/2011 |

OTHER PUBLICATIONS

Fignerprint wall safe shown on the Alibaba website, http://www.alibaba.com/product-gs/742907677/Mini_safes_fingerprint_wall_safe_Luxury.html.

(Continued)

*Primary Examiner* — Eric M Blount
(74) *Attorney, Agent, or Firm* — William F. Lang, IV; Lang Patent Law LLC

(57) ABSTRACT

An electronic wall safe is intended to fit between the support beams of a typical building, bolting into the beams on either side of the safe. A panel is provided around the safe to prevent cutting into the wall to remove the safe. The safe includes numerous electronic features, which are powered by running an electrical wire to the safe, as well as battery backup. The CPU includes a connection for a telephone line, as well as wireless communication. The safe utilizes a fast-opening mechanism such as a fingerprint scanner. A panic button is provided to alert authorities and/or others on the premises of the emergency. The safe includes a mercury switch so that, if the safe is moved, then the opening mechanism will be disabled, and police will be notified. The safe includes cut wire detection circuitry. One possible variation of the safe includes a door having a shatter-resistant window, as well as internal lighting, so that the contents of the safe can be displayed or verified without opening the safe.

10 Claims, 4 Drawing Sheets

(56) References Cited

U.S. PATENT DOCUMENTS

| | | | | |
|---|---|---|---|---|
| 2006/0011111 | A1* | 1/2006 | Stoddard et al. | 109/1 R |
| 2006/0138915 | A1* | 6/2006 | Goldberg | 312/223.3 |
| 2008/0246375 | A1* | 10/2008 | Berg | 312/114 |
| 2009/0165682 | A1 | 7/2009 | Cleveland et al. | |
| 2011/0079170 | A1* | 4/2011 | Al-Mutairi | 109/23 |
| 2011/0175730 | A1 | 7/2011 | Stevenson | |
| 2011/0279225 | A1* | 11/2011 | Frontino et al. | 340/5.3 |
| 2012/0092281 | A1* | 4/2012 | Gilbertson et al. | 345/173 |
| 2013/0298807 | A1* | 11/2013 | Wall et al. | 109/38 |
| 2014/0103785 | A1* | 4/2014 | Richards | 312/204 |

OTHER PUBLICATIONS

Schematic diagram for a cut phone line detector, http://www.aaroncake.net/CIRCUITS/phonecut.asp.

* cited by examiner

ELECTRONIC SAFE

CROSS REFERENCE TO RELATED APPLICATION

This application claims the benefit of U.S. Provisional Patent Application No. 61/786,282, filed on Mar. 14, 2013, and entitled "Electronic Wall Safe."

TECHNICAL FIELD

The present invention relates to safes. More specifically, an improved electronic wall safe is provided.

BACKGROUND INFORMATION

Firearms have been one of the most effective tools of self-defense almost since their initial invention. Responsible gun owners realize that firearms must not only be kept readily available, but also properly secured from unauthorized individuals. In particular, recent school shootings have revealed both the need to have firearms available to qualified, authorized personnel in order to protect children within the school. While concealed handguns are helpful for this purpose, not everyone interested with the safety of children may be willing to carry a handgun on a daily basis. Furthermore, some situations may best be handled with long guns such as modern sporting rifles. The ability to secure appropriate weapons within a school, in a manner that is accessible to numerous authorized individuals while resisting access to unauthorized individuals is desirable. Access by unauthorized individuals could potentially occur by unauthorized opening of a safe containing the firearms, or by theft of the safe containing the firearms, and resisting both is important. Additionally, in the event of an emergency requiring access to the firearm, quickly notifying others of the emergency is critical for enabling teachers to lock down their classrooms and hide their children, as well as alerting authorities who can provide assistance. Furthermore, those who need access to the firearm also need to be able to verify the presence of the firearm within the safe, as well as the status of the firearm. Frequency administrative handling of the firearm could potentially increase the risk of an accidental discharge. Therefore, it would be desirable for those with access to the firearm to be able to verify its presence and status without opening the safe.

U.S. Pat. No. 7,178,370 discloses a gun safe. The safe is mounted in a wall by screws going into the studs on either side of the safe. A biometric sensor detects a fingerprint, actuating a solenoid to retract the latch if the fingerprint is recognized. The sensor may include a light sensor and means of lighting the sensor when dark. The door drops open due to gravity, being slowed by a spring-loaded cable unit. A port is provided for auxiliary power if the battery dies, and/or an auxiliary microprocessor if the microprocessor dies. Key backup with a hidden keyhole may be provided. This gun safe fails to provide any means of communicating unauthorized access and/or theft, or any means of verifying its contents without opening the safe.

US 2009/0165682 discloses a safe with data transfer capability. Monitored data may include temperature, humidity, battery life, unsuccessful opening attempts, times when the door is opened, etc. The safe may include a motion sensor for detecting when the safe is being stolen and may initiate an audio and/or visual alarm. Messages may be sent by e-mail, page, fax, text message, or instant message upon an alarm condition. An environmental control module and camera may be included. A radiofrequency module can send a signal to the police if the safe is broken into. This gun safe fails to provide any means of verifying its contents without opening the safe.

U.S. Pat. No. 7,116,224 discloses a portable case for securing a firearm. The case may include an electronic lock, but preferably includes a mechanical lock. The case includes a wireless or hardwired interface with any of several different premises alarm systems. If a wireless transmitter is used, it is powered by batteries. Sensors within the case may detect opening the case, removing the case from its resting place, vibration of the case, motion of the case, or other conditions. A mercury switch is specifically mentioned as one option. A panic button may be provided to signal duress or other emergencies, and may be used by an authorized individual as a means of alerting authorities after the authorized user has accessed the firearm. In the event that a sensor is actuated, the transmitter may actuate the alarm and/or utilize the alarm system's features for notifying authorities. This gun safe fails to provide any means of verifying its contents without opening the safe.

U.S. Pat. No. 6,363,760 discloses a wall safe for handguns. The wall safe is intended to fit between adjacent wall studs, utilizing a telescoping mounting bracket to fit various wall configurations. Access to the safe is by an electronic touch keypad. The electronics in the safe may be powered by battery, alternating current, or a combination of the two. The electronics may integrate with a pre-existing premises security system. In appropriate circumstances, the security system panic mode may be activated, sending a signal to a monitoring facility. This gun safe fails to provide any means of verifying its contents without opening the safe.

The Alibaba website discloses a wall safe that is hidden behind a painting. The safe is locked by a combination of a fingerprint lock and an electromechanical lock. The safe includes an alarm that is actuated if the safe is shaken, or if the wrong fingerprint is entered five times. An emergency locking system is actuated if the wrong fingerprint is entered repeatedly. The fingerprint sensor detects finger temperature to avoid being fooled by a fake fingerprint. The safe includes a low battery alarm and external emergency power. his gun safe fails to provide any means of verifying its contents without opening the safe.

US 2011/0175730 discloses a gun safe that is operatively connected to an alarm system. The safe is designed to receive a signal (which may be wired, wireless, and/or audible) from the alarm system indicating that a break-in is occurring. When such a signal is received, the gun safe may perform any of several actions, including opening the door, switching to a simplified access code for opening the door, making opening the door more difficult, or deactivating the opening mechanism. The selected behavior may be changed depending on whether authorized individuals are likely to be present. Another alarm may sound when the door is open. Opening the door may further actuate a light within the safe. The safe may be concealed within a piece of furniture or installed in a wall. Although this safe provides for receiving signals from external devices, little is taught about providing communication to external entities.

EP 2 273 052 discloses a masking device for wall embedded equipment. The device includes a fastening plate that this reciprocally mounted to a pair of sliding rails. A picture may be hung from the fastening plate.

U.S. Pat. No. 5,987,941 discloses a handgun safe. The handgun is stored in a rotating hopper. An electronic lock actuates a solenoid to retract a pin against spring bias, permitting the hopper to rotate down. The safe may be integrated with a security system to sound an alarm when the safe is opened.

U.S. Pat. No. 5,901,589 discloses a wall-mounted handgun safe. The safe is secured to the studs within a wall. The door is made to appear to hinge open, when in fact it is opened by depressing it against spring pressure and then sliding it into a channel. An additional key or combination lock may be used when security outweighs fast access. The safe may be hidden behind a fake furnace air intake.

U.S. Pat. No. 5,586,934 discloses a wall safe that is structured to fit within an air return duct.

U.S. Pat. No. 5,111,755 discloses a handgun safe. Opening the handgun safe requires first entering the proper code into the keyboard. Once the proper code is entered, a solenoid plunger unlocks a secondary child deterrent mechanical device in the form of a knob. The knob must then be pushed, pulled, and turned in a particular sequence to open the safe. Upon proper manipulation of the child deterrent knob, a drawer opens.

U.S. Pat. No. 2,693,772 discloses a wall safe that is hidden behind a picture frame that is hingedly secured to the wall. The safe is held closed by a lock bolt that is controlled by a solenoid. Actuating the solenoid requires closing a wall switch, as well as closing a key actuated switch.

U.S. Pat. No. 2,732,816 discloses a wall safe that is hidden by painting or wallpapering the door so that it appears to be part of the wall. The door is held closed by a solenoid that is controlled by a switch that is concealed in a different location, with power being supplied by a wire running from the switch to the wall safe. Hinges contained within the door are provided with a spring biased plunger for pushing the door open when the solenoid is actuated.

Accordingly, there is a need for an electronic gun safe that facilitates not only access to the interior of the safe, but also communication of the existence of an emergency, both with others on the premises, and with authorities and/or a monitoring service. There is a further need for an electronic gun safe that provides such communication in response to either unauthorized opening, unauthorized tampering, and/or unauthorized movements of the safe. There is an additional need for a gun safe that allows verification of the contents of the safe without opening the safe.

SUMMARY

Another embodiment of the safe has a body and a door hingedly secured to the body. A locking mechanism is provided. The locking mechanism includes a user interface that is structured to rapidly open the locking mechanism in response to input by an authorized user. A panic button is also provided. The safe has a central processing unit that is structured to selectively provide one of a plurality of responses to actuation of a panic button.

Another example of the electronic wall safe includes a body, and a door hingedly secured to the body. The door has a transparent, shatter resistant portion.

Yet another example of the electronic wall safe includes a body that is structured to be secured between a pair of studs in a wall. An anti-cut panel extends outwardly from the body, in close proximity to a wall when the body is installed in a wall.

A further example of an improved electronic wall safe. The safe has a body and a door hingedly secured to the body. A locking mechanism is provided. The locking mechanism includes a user interface that is structured to rapidly open the locking mechanism in response to input by an authorized user. A cut wire detection system, as well as a communication system, are also provided. The safe has a central processing unit that is structured to send a signal to a preselected entity through the communication system upon receiving a signal from the cut wire detection system.

These and other aspects of the invention will become more apparent through the following description and drawings.

BRIEF DESCRIPTION OF THE DRAWINGS

Like reference characters denote like elements throughout the drawings.

DETAILED DESCRIPTION

Figure 1:
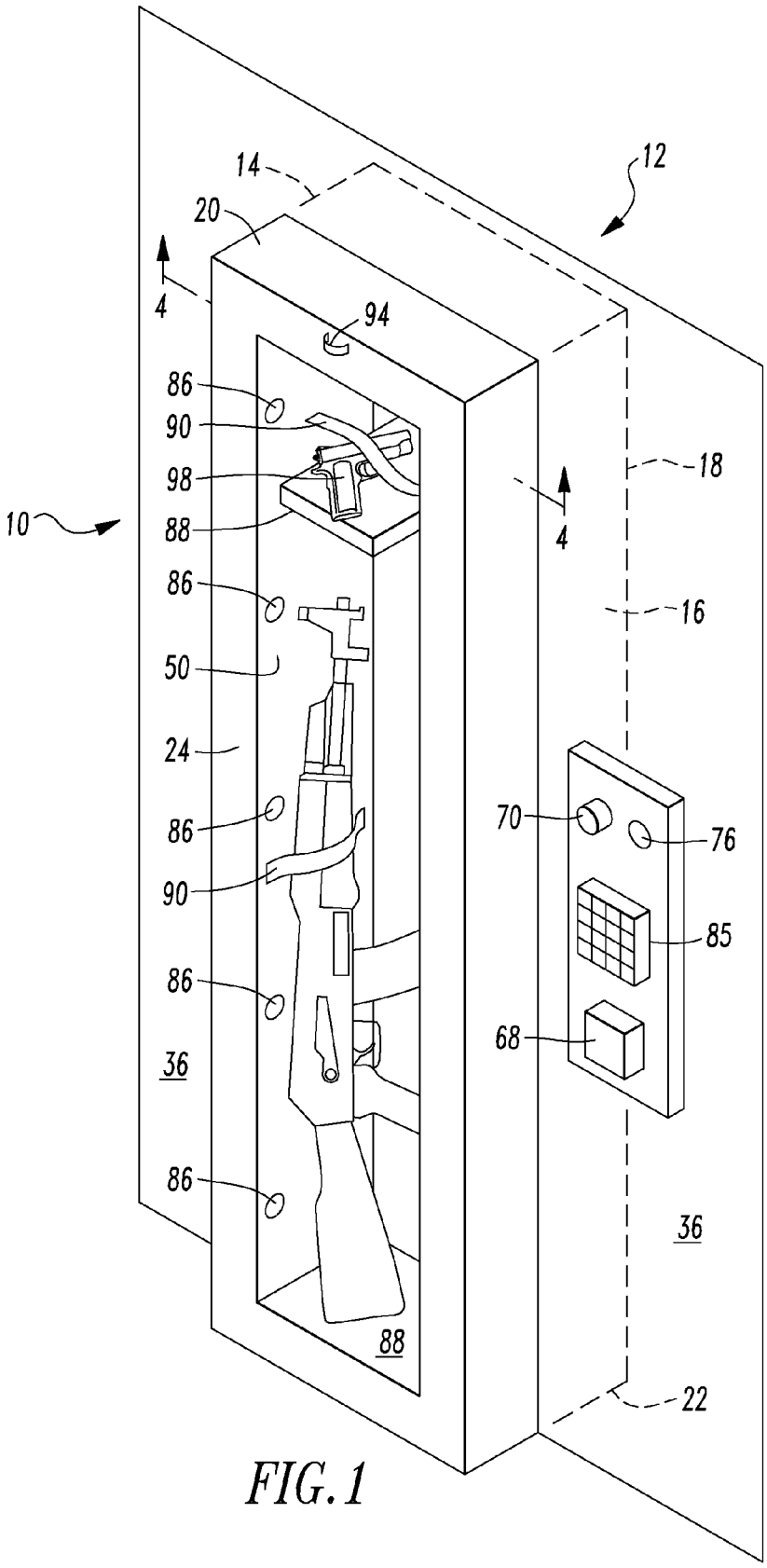
FIG. 1 is a perspective view of an electronic wall safe, showing the door closed.
Figure 2:
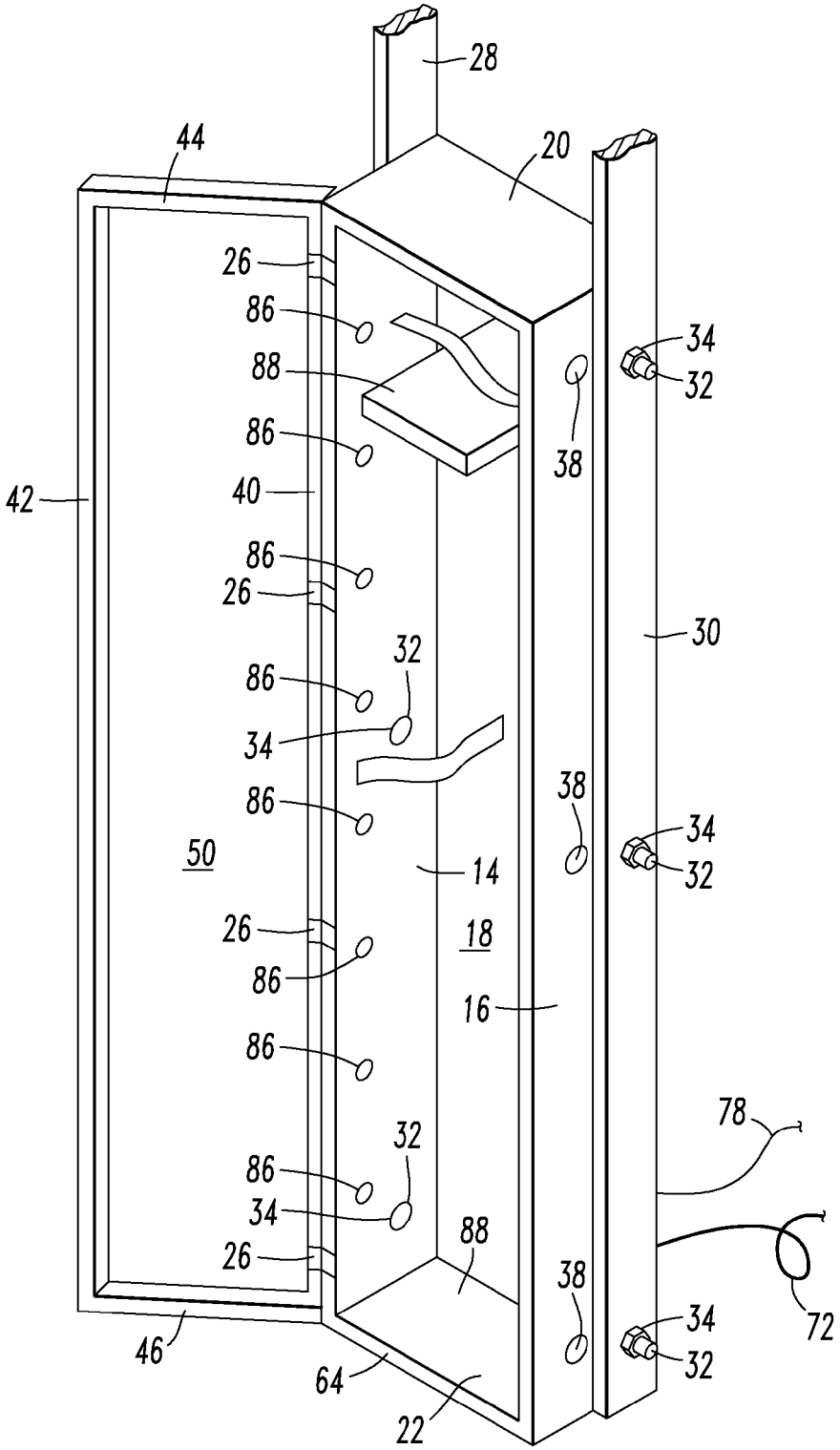
FIG. 2 is a perspective view of the electronic wall safe of FIG. 1, showing the door open and the anti-cut plate and drywall omitted.

Referring to the drawings, an example of a safe 10 is illustrated. Although a wall safe is illustrated, the safe can be secured within floors, or against other generally planar building portions having adjacent building frame members such as wall "studs" or floor joists, or the like, without departing from the scope of the invention. Although the illustrated example of the safe 10 is sized to hold a modern sporting rifle, other sizes, such as those designed only to hold handguns, those designed to hold money and/or jewelry, or sizes designed to hold important papers, are all within the scope of the invention. Referring to FIGS. 1-2, the wall safe 10 includes a body 12 having a left side 14, right side 16, back 18, top 20, and bottom 22. A door 24 is hingedly attached to the body 12, in the illustrated example being hingedly attached to the left side 14 by internal hinges 26 (FIG. 2). The safe 10 is structured to be secured between the frame members or "studs" 28, 30 (FIG. 2) within a typical wall. In the illustrated example, the right side 16 and left side 14 are provided with a plurality of bolts 32, which are secured within holes within the studs 28, 30 by nuts 34 on the opposite sides of the studs 28, 30. An anti-cut plate 36 (FIG. 1) is secured to at least the left side 14 and right side 16. In the illustrated example, the anti-cut panel is also secured to the top 20 and bottom 22. The anti-cut plate 36 extends beyond the studs 28, 30 in order to increase the difficulty of cutting the safe 10 from a wall.

Figure 3:
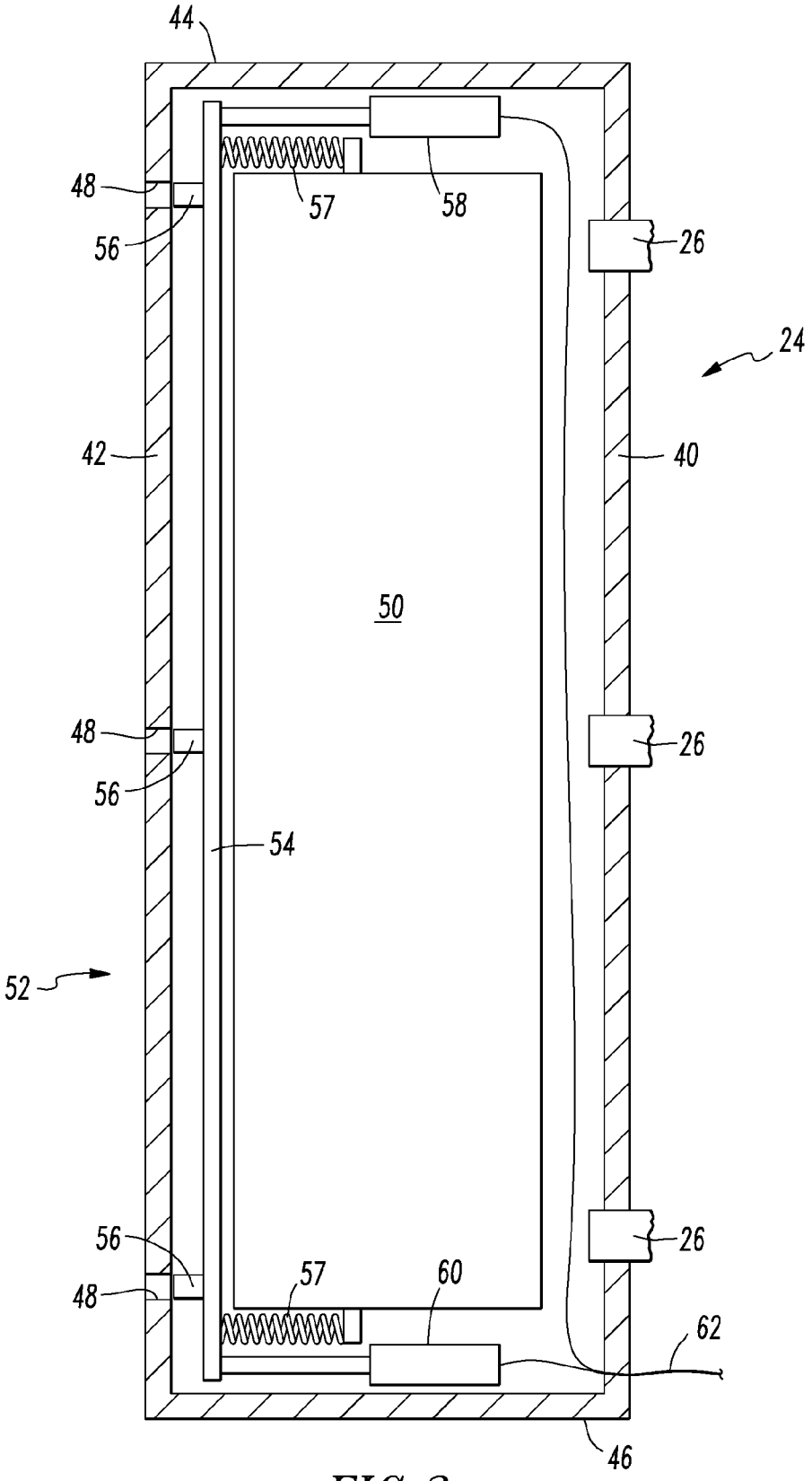
FIG. 3 is a back view of a door and locking mechanism for an electronic wall safe.
Figure 4:
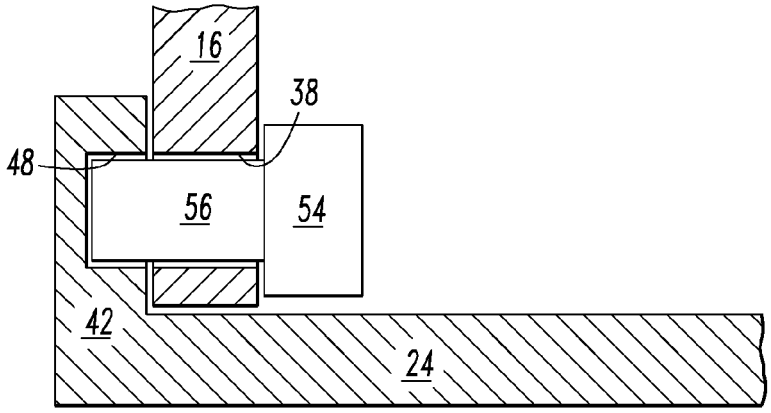
FIG. 4 is a cross-sectional view of a wall and door for an electronic wall safe of FIG. 1, taken along the lines 4-4 of FIG. 1.

The illustrated example of the left side 14, right side 16, top 20, and bottom 22 are sufficiently wide to extend a short distance out of the wall. One of the sides, which in the illustrated example is the right side 16, is provided with a plurality of apertures 38 for receiving the locking bolts that are described in greater detail below. The door 24, which is best illustrated in FIGS. 2-4, includes a left side lip 40, a right side lip 42, an upper lip 44, and a lower lip 46 that are structured to overlap the portions of the left side 14, right side 16, top 20, and bottom 22 that protrude from the wall, and to lie within close proximity to these components in order to resist prying open the door 24. The right side lip 42 is provided with a plurality of apertures 48 that are substantially aligned with the apertures 38, and which extend only partially through the lip 42. Some examples of the door 24 include a window 50, permitting visual verification of the contents of the safe 10 without the need to open the safe 10.

Referring to FIGS. 3-4, the interior of the door 24 is illustrated. The locking mechanism 52 may be visible, or may be covered by an interior door panel, but is illustrated as visible in FIG. 3 so that its components can best be explained. The locking mechanism includes a beam 54 extending substantially along the right side lip 42 of the door 24. A plurality of locking bolts 56 are secured to the beam 54, with one locking bolt 56 corresponding to each of the apertures 48. The beam 54 is reciprocally secured to the door 24, so that the bolts 56 may move from an open position wherein they do not protrude from the apertures 48, and a closed position wherein the bolts 56 protrude from the apertures 48 a sufficient distance to engage the apertures 38. The beam 54 is biased towards the closed position by at least one spring 57, with the illustrated example including a pair of springs 57. Movement of the beam 54 is controlled by at least one solenoid, with an upper solenoid 58 and lower solenoid 60 being shown in the illustrated example. The solenoids 58, 60 are structured to position the beam 54 in the closed position when not energized and to move the beam 54 into the open position when energized. Power is supplied to the solenoids 58, 60 by the wire 62. Although the illustrated example of the locking mechanism 52 provides bolts 56 only along one side of the door 24, other examples of the locking mechanism 52 may provide bolts along two sides of the door 24, or along four sides of the door 24. In each case, the structure and functioning of the bolts may be essentially the same.

Figure 5:
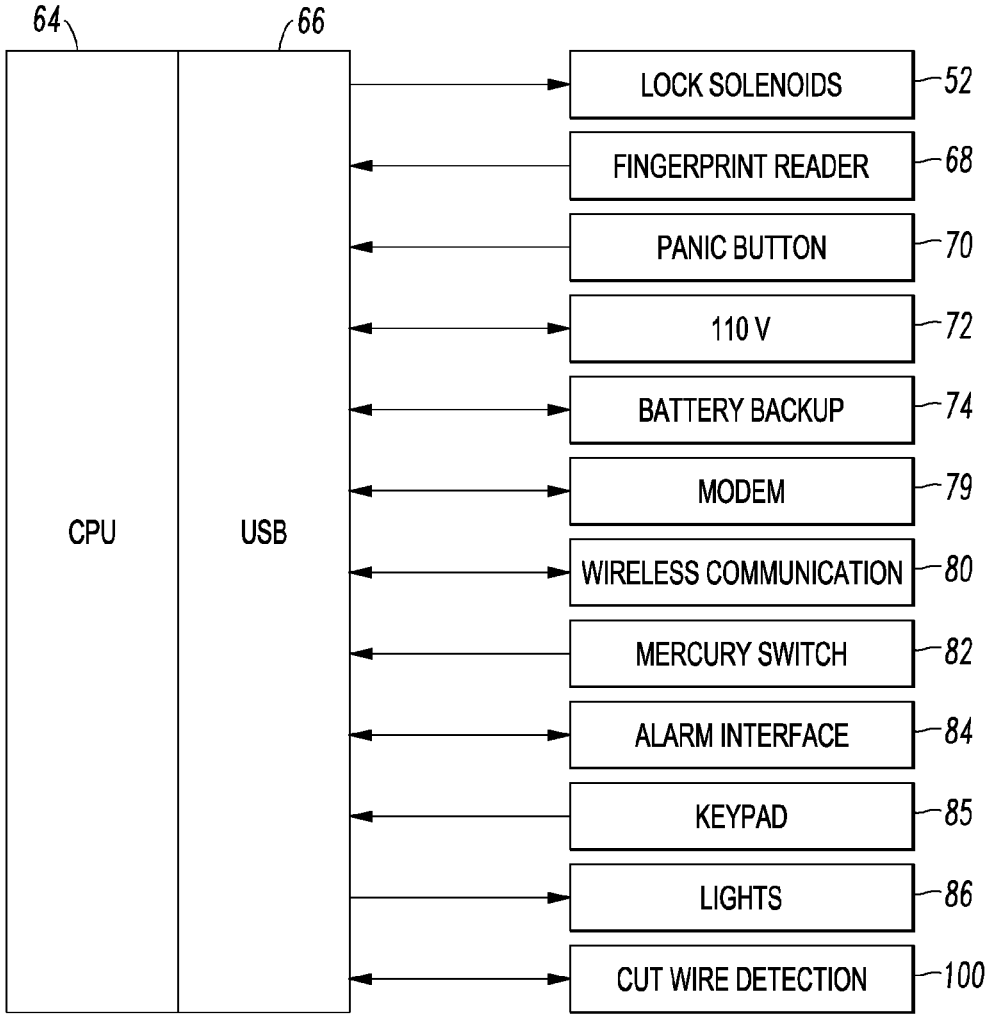
FIG. 5 is a schematic diagram of the electronic components of an electronic wall safe of FIG. 1.

Control of the locking mechanism 52, as well as of the other functions of the safe 10, are controlled by a central processing unit (CPU) 64. The illustrated example of the safe 10 locates the central processing unit 64, as well as most of the other electronics described below, at the bottom of the safe 10. Referring to FIGS. 1 and 5, the interface of the various components of the safe 10 with the universal service bus (USB) system 66 of the CPU 64 is illustrated.

Opening the safe 10 is controlled by an external input device, which in the illustrated example is a fingerprint reader 68, disposed on the anti-cut plate 36. The illustrated fingerprint reader 68 is disposed on the anti-cut plate 36. The CPU 64 may be programmed with the fingerprints of individuals who are authorized to open the safe 10, and will actuate the locking mechanism 52 when a fingerprint from one of these individuals is read by the fingerprint reader 68. A panic button 70 is also accessible from outside the safe 10. The panic button 70 is spaced from the fingerprint reader 68 to resist accidental activation of the panic button 70, but is also positioned where an authorized individual may quickly and easily activate both the fingerprint reader 68 and panic button 70. When the panic button 70 is pressed, any of multiple actions may be taken by the CPU, depending on the programming of the CPU, as well as whether or not the locking mechanism 52 has been actuated through the fingerprint reader 68, as explained in greater detail below.

Power for the illustrated example of the safe 10 is supplied by hardwiring the CPU 64 to the electrical wiring of the building in which the safe 10 is installed, with the power cord 72 supplying the primary power to the CPU 64 and other electronic components. A battery backup power supply 74 is also provided for powering the safe 10 in the event of a power failure and/or a cut power cord 72. The battery within the battery backup power supply 74 may be either a primary cell that requires periodic user replacement, or a secondary cell that recharges from the power cord 72. The battery backup power supply 74 is structured to monitor the status of the battery charge, and to activate a low battery indicator 76 in the event that battery voltage drops below a predetermined threshold. The low battery indicator 76 may be a visual indicator such as an LED, an audio indicator such as a speaker, or a combination of the two. Additionally, the CPU 64 may be programmed to switch off non-essential functions in the event that battery backup power is required. For example, the light described below may be switched off in the event that battery backup power is in use in order to maximize the life of the battery backup power supply 74.

The safe 10 may include multiple communication interfaces. A telephone line 78 may be connected to a modem 79 that is connected to the USB 66, providing for telephone communication with local authorities, a monitoring company, and/or other individuals of the user's choosing. A cellular communication device 80 may also be connected to the USB 66 for communication with local authorities, a monitoring company, and/or other individuals of the user's choosing in the event that the telephone line 78 is cut. Additionally, the cellular communication device may communicate with a user's mobile telephone.

A motion sensor 82 is provided within the safe 10. The illustrated motion sensor 82 is a mercury switch that is structured to detect tilting of the safe, as would likely occur if the safe were removed from the building in which it has been installed. In the event that the mercury switch 82 is tripped at a time when an authorized user is not moving the safe 10, one or more of the above-described communication interfaces may be used to alert authorized users and/or authorities that the safe 10 is being stolen. Additionally, the opening mechanism of the safe is disabled until reset by an authorized user and/or a monitoring service.

An alarm system interface 84 is connected to the USB 66. The alarm system interface 66 is configured to interface with the wireless communication systems of many presently available premises alarm systems.

A keypad 85 may be provided so that authorized users may program the CPU 64 to function in a desired manner, as explained in more detail below. Additionally, or alternatively, the wireless communication system 80 may interface with an authorized user's mobile telephone, so that the user may program the CPU 64 through the mobile telephone. In the case of a "smart phone," a software application may be provided for installation on the smart phone in order to interface with the CPU 64.

Some examples of the safe 64 may include a detection device 100 for cut wires between the CPU 64 and other electronic components, the power supply, and/or the telephone line. A system for detecting cut wires is described within U.S. Pat. No. 5,387,899, issued of Feb. 7, 1995 to A. A. DiLauro et al., the entire disclosure of which is expressly incorporated herein by reference. A system for detecting a cut telephone line is disclosed within U.S. Pat. No. 4,737,776, which was issued to W. Wireman on Apr. 12, 1988, the entire disclosure of which is expressly incorporated herein by reference. Another system for detecting a cut telephone line is disclosed within U.S. Pat. No. 5,737,391, which was issued to R. J. Dame et al. on Apr. 7, 1998, the entire disclosure of which is expressly incorporated herein by reference. The output from any wire or line cut detector can be utilized to provide a signal to the CPU 64 in the event that a cut wire is detected. The CPU 64 can be programmed to notify authorized users, a monitoring service, and/or authorities. Additionally, or alternatively, a local premises alarm may be activated.

A light 86 may be provided within the safe 10. In the illustrated example, multiple light sources 10, such as the illustrated light emitting diodes (LED) are positioned around the interior of the safe 10 to avoid shadows within the safe 10. Some examples of the safe 10 may be structured to activate the light 86 upon opening the door 24. This can be accomplished through a simple switch that is activated by the door 24, or through programming of the CPU 64. Alternatively, the light 86 may be controlled through a manual external control, permitting users to selectively view the contents of the safe 10. As another alternative, the light 86 may remain constantly on, permitting viewing the contents of the safe 10 at any time. Viewing the contents of the safe without opening the safe may be desirable, for example, for users who wish to verify the presence and state of readiness of a weapon secured within the safe without opening the safe.

The safe 10 may be made from any suitable materials, with a preferred material being steel. Some examples of the safe 10 may be made from carbon steel having a blued finish of the type traditionally applied to carbon steel firearms. If a window 50 is provided within the door 24, that window is made from a shatter resistant material. Some examples of the window 50 may be made from polycarbonate, with one example of a suitable polycarbonate material being marketed by Bayer MaterialScience LLC, of Sheffield, Mass., under the trademark MACROLON. Some examples of the safe 10 may include fire resistant walls, in a manner that is well known in the art of safes.

The interior of the illustrated example of the safe 10 is lined with felt, in order to avoid damaging the finish of any firearms stored within. One or more shelves 88 may be provided within the safe for supporting the weight of a long gun or handgun. Straps 90 may be secured to the sides 14, 16 and/or back 18 by hook and loop fasteners to secure firearms in a desired position on the shelves 88, while leaving the firearms rapidly accessible once the safe 10 is opened.

The safe 10 may include a pin or hook 94 disposed centrally near the top of the safe 10. A picture or other decorative wall hanging may be hung from the pin or hook 94 in order to hide or disguise the safe 10. With the fingerprint reader 68 and panic button 70 disposed on the anti-cut plate 36, an authorized user may quickly access the safe 10 by reaching underneath a picture or decorative wall hanging that is been positioned over the safe 10 to activate the fingerprint reader 68 and/or panic button 70 without a need to remove the decorative wall hanging from the pin or hook 94.

The safe 10 may be used to secure a firearm such as a modern sporting rifle 96 and/or handgun 98 therein. The safe 10 is particularly useful in a location where both authorized and unauthorized individuals will be present, such as a school having personnel authorized to provide security during an emergency. The light(s) 86 may illuminate the contents of the safe 10, permitting authorized personnel to verify the contents of the safe 10 without the need to open the safe 10. An authorized individual may open the safe by placing a finger on the fingerprint reader 68. The CPU 64 compares the fingerprint with authorized fingerprints within its memory, and activates the solenoids 58, 60 to permit the door 24 to be opened. Firearms secured therein may then be quickly grabbed and pulled away from the sides 14. 16 and/or back 18, with the force of the grabbing and pulling action causing the hook and loop straps 90 to detach. The firearms may then be utilized for defense. Once the firearms are returned to the safe 10, the door 24 may be closed, and the safe may be re-locked, in some examples by using the keypad 85 to trigger the locking mechanism.

The CPU 64 may be programmed so that the panic button 70 may be used to notify others of an emergency, operating in various ways depending on the location of the safe 10 and notifications desired. For example, if the safe 10 is installed within a school, it is anticipated that numerous unauthorized individuals may have access to the panic button 70. Therefore, the panic button 70 may be inoperative unless and until an authorized fingerprint is read by the fingerprint reader 68, at which point the CPU 64 will look for signals from the panic button 70 for a predetermined time interval. Once the panic button 70 is depressed, the CPU may relay a preprogrammed message to authorities and/or a monitoring service utilizing the telephone line 78 and/or wireless communication device 80. The CPU may further, or alternatively, activate a local premises alarm through the alarm system interface 84. The premises alarm may be a standard burglar alarm, or may be an alarm triggering a lockdown in a school. An additional notification may be made to the mobile telephones of other authorized personnel using the wireless communication device 80.

Alternatively, it may be desirable for unauthorized individuals be able to activate the panic button 70. For example, a residence containing the safe 10 may contain unauthorized individuals, and a fast, quiet way for these individuals to summon help may be desired. In this case, the CPU 64 may be programmed to send different messages, depending on whether an authorized fingerprint is recognized by the fingerprint scanner 68. If an authorized individual has activated the panic button 70, authorities may be notified of the location of the emergency, the telephone number of the resident, and the fact that the resident is armed. This information can be utilized to minimize any likelihood of a shooting based on mistaken identity when authorities arrive. If an unauthorized individual has activated the panic button 70, then the message may indicate the location of the emergency, and the fact that the individual has not gained access to a weapon, and therefore needs assistance more quickly.

An improved electronic wall safe is therefore provided. The electronic wall safe may be securely mounted between the studs on a wall, being secured to the studs in a particularly solid manner. The electronic wall safe may be accessed quickly by authorized users. Other individuals on the premises, and/or the authorities, may be quickly notified of emergencies utilizing features of the electronic wall safe. The contents of the safe are securely held in position, but may be quickly withdrawn when needed. The electronic wall safe includes motion sensors and/or wire cut detectors to detect when someone is attempting to steal the electronic wall safe, so that appropriate individuals or entities may be notified. Some examples of the electronic wall safe are designed so that the contents of the safe may be verified without a need to open the safe. Some examples may be hidden behind a picture or other decorative wall hanging positioned over the electronic wall safe.

A variety of modifications to the above-described embodiments will be apparent to those skilled in the art from this disclosure. Thus, the invention may be embodied in other specific forms without departing from the spirit or essential attributes thereof. The particular embodiments disclosed are meant to be illustrative only and not limiting as to the scope of the invention. The appended claims, rather than to the foregoing specification, should be referenced to indicate the scope of the invention.

What is claimed is:

1. An electronic safe, comprising:

a body;

a door hingedly secured to the body;

a locking mechanism;

a locking mechanism user interface structured to rapidly open the locking mechanism in response to input by an authorized user;

a panic button; and a central processing unit structured to determine whether an authorized user has provided input to the locking mechanism, to provide a first response to actuation of the panic button if an authorized user has provided input to the locking mechanism, and a second response to actuation of the panic button if an authorized user has not provided input to the locking mechanism.

2. The electronic safe according to claim 1, further comprising:

a body; and a door hingedly secured to the body, the door having a transparent, shatter resistant portion.

3. The electronic safe according to claim 2, further comprising at least one light source disposed within an interior of the body.

4. The electronic safe according to claim 3, further comprising:

a connection for connecting to an electrical system of a building;

a battery backup system, a microcontroller that is structured to select the electrical system of a building for electrical power when the electrical system of the building is supplying electrical power to the safe, and to select the battery backup system when electrical power is not being supplied to the safe by the electrical system of the building; and wherein the microcontroller is structured to deactivate the at least one light source in the event that power is being supplied from the battery backup system.

5. The electronic safe according to claim 4, further comprising:

a communication system;

a cut wire detection system; and the central processing unit is further structured to send a signal to a preselected destination through the communication system in response to a signal from the cut wire detection system.

6. The electronic safe according to claim 2, further comprising:

a body that is structured to be secured between two building frame members, the body defining at least three exterior walls, each of the exterior walls defining a length; and a single anti-cut panel rigidly secured to and extending outwardly from the body, the anti-cut panel being structured to lie in close proximity to and substantially parallel to the generally planar structure when the body is installed in a building, the anti-cut panel extending along the entire length of three exterior walls.

7. The electronic safe according to claim 6, further comprising:

a communication system;

a cut wire detection system; and the central processing unit is further structured to send a signal to a preselected destination through the communication system in response to a signal from the cut wire detection system.

8. The electronic safe according to claim 1, further comprising:

a body that is structured to be secured between two building frame members, the body defining at least three exterior walls, each of the exterior walls defining a length; and a single anti-cut panel rigidly secured to and extending outwardly from the body, the anti-cut panel being structured to lie in close proximity to and substantially parallel to the generally planar structure when the body is installed in a building, the anti-cut panel extending along the entire length of three exterior walls.

9. The electronic safe according to claim 8, further comprising:

a communication system;

a cut wire detection system; and the central processing unit is further structured to send a signal to a preselected destination through the communication system in response to a signal from the cut wire detection system.

10. An electronic safe for installation in a building, the building having at least a pair of frame members and a generally planar structure disposed adjacent to the at least two frame members, the electronic safe comprising:

a body that is structured to be secured between two building frame members, the body defining at least three exterior walls, each of the exterior walls defining a length; and a single anti-cut panel rigidly secured to and extending outwardly from the body, the anti-cut panel being structured to lie in close proximity to and substantially parallel to the generally planar structure when the body is installed in a building, the anti-cut panel extending along the entire length of three exterior walls.

* * * * *